US006289785B1

(12) United States Patent
Ikeda et al.

(10) Patent No.: US 6,289,785 B1
(45) **Date of Patent: *Sep. 18, 2001**

(54) SWASH PLATE TYPE COMPRESSOR

(75) Inventors: Hayato Ikeda; Masafumi Kato; Takayuki Kato, all of Aichi-ken (JP)

(73) Assignee: Kabushiki Kaisha Toyoda Jidoshokki Seisakusho

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/975,258

(22) Filed: Nov. 20, 1997

(30) Foreign Application Priority Data

Nov. 21, 1996 (JP) ..... 8-310997
Oct. 24, 1997 (JP) ..... 9-291960

(51) Int. Cl.[7] ..... F01B 3/00

(52) U.S. Cl. ..... 92/71; 92/12.2; 74/60; 417/269

(58) Field of Search ..... 92/12.2, 71; 74/60; 417/269; 91/499

(56) References Cited

U.S. PATENT DOCUMENTS

| | | | | |
|---|---|---|---|---|
| 4,037,522 | * | 7/1977 | Inoshita et al. | 92/71 |
| 4,568,252 | * | 2/1986 | Hattori et al. | 417/269 |
| 4,934,442 | | 6/1990 | Futamura et al. . | |
| 5,056,417 | * | 10/1991 | Kato et al. | 92/71 |
| 5,057,274 | * | 10/1991 | Futamura et al. | 420/534 |
| 5,655,432 | * | 8/1997 | Wilkosz et al. | 92/71 |
| 5,845,560 | * | 12/1998 | Nagata et al. | 92/71 |
| 5,851,320 | * | 12/1998 | Auran et al. | 148/552 |
| 5,875,702 | | 3/1999 | Kawagoe et al. | 92/12.2 |

FOREIGN PATENT DOCUMENTS

| | | |
|---|---|---|
| 0 679 809 | 11/1995 | (EP) . |
| 6-022080 | 2/1985 | (JP) . |
| 61-291941 | 12/1986 | (JP) . |
| 2-130272 | 5/1990 | (JP) . |
| 8-199327 | 8/1996 | (JP) . |
| PCT/JP96/01293 | 11/1996 | (JP) . |

OTHER PUBLICATIONS

Patent Abstracts of Japan Publication No. 10205442, published Aug. 4, 1998.

Patent Abstracts of Japan Publication No. 08199327, published Aug. 6, 1996.

Patent Abstracts of Japan Publication No. 05071528, published Mar. 23, 1993.

* cited by examiner

*Primary Examiner*—Hoang Nguyen
(74) *Attorney, Agent, or Firm*—Morgan & Finnegan, LLP

(57) ABSTRACT

A swash plate type compressor that provides long lasting high lubricating performance to the sliding contact surfaces of a swash plate and shoes. The surface of the swash plate or the shoes on which the swash plate comes in sliding contact with the shoes is provided with an alloy plating layer, in which tin is the main component, as a surface treating layer. A coating layer, in which molybdenum disulfide is the main component, is formed as a solid lubricant layer on the foregoing plating layer. Preferably, the swash plate is made of aluminum or an aluminum alloy, and its surface is provided with the plating layer and the coating layer. More preferably, the coating layer contains graphite.

10 Claims, 2 Drawing Sheets

SWASH PLATE TYPE COMPRESSOR

BACKGROUND OF THE INVENTION

1. Field of the Invention

The present invention relates to a swash plate type compressor and, more particularly, to improved lubricating performance of the sliding contact surfaces of a swash plate and a shoe of the compressor.

2. Description of the Related Art

Hitherto, swash plate type compressors have been used as an apparatus for compressing refrigerant gas in automotive climate control systems. Such swash plate type compressors are equipped with a cylinder block assembly which has a plurality of cylinder bores provided parallel to a drive shaft; a swash plate secured to the drive shaft so as to be rotated by the drive shaft in the cylinder block assembly; pistons slidably fitted to reciprocate in the cylinder bores to compress the refrigerant gas; and shoes which are provided between the pistons and the swash plate which reciprocate the pistons in response to the rotation of the swash plate.

In the above swash plate type compressor, high load and high sliding speed regularly act on the sliding contact surfaces of the swash plate and the shoes. Accordingly the sliding contact surfaces of the swash plate and the shoes are apt to become dry due to any insufficient supply of lubricating oil. This poses a problem especially where aluminum or an aluminum alloy is used as the base metal of the swash plate because of its light weight.

To solve this problem, as disclosed in Japanese Patent Application Laid-open No. 60-22080, at least the swash plate or the shoes employ aluminum or an aluminum alloy as the base metal with the sliding contact surface thereof coated with an alloy which contains molybdenum disulfide (MoS2) as the main component. Another solution has been proposed in Japanese Patent Application Laid-open No. 2-130272, in which the surface of the swash plate is plated with an alloy, in which tin is the main component, to form a surface treating layer.

In the former solution, although the solid lubricant layer, containing molybdenum disulfide as the main component, exhibits good lubricating performance, it has such shortcomings as poor wear resistance and a short service life.

The latter solution provides a high degree of hardness and accordingly good wear resistance; however, it is disadvantageous in that the lubricating performance is not as high as that of the former solution.

SUMMARY OF THE INVENTION

The present invention has been made with a view toward solving the problems with the prior art described above, and it is an object of the invention to improve the lubricating performance of the sliding contact surfaces of a swash plate and a shoe and to maintain the improved lubricating performance for a long period of time.

To this end, according to the present invention, there is provided a swash plate type compressor equipped with: a cylinder block assembly which has a plurality of cylinder bores provided parallel to a drive shaft; the drive shaft rotatably held in the cylinder block assembly; a swash plate which is rotatably disposed to the drive shaft in the cylinder block assembly; pistons slidably disposed in the cylinder bores; and shoes which are slidably provided between the pistons and the swash plate which reciprocates the pistons in response to the rotation of the swash plate; wherein the swash plate and the shoes are in sliding contact, a sliding contact surface of the swash plate or the shoes being covered with a plating layer composed of tin or an alloy containing tin as the main component, and the plating layer being covered with a coating layer composed of molybdenum disulfide as the main component which serves as a solid lubricant layer.

The plating layer composed of tin or an alloy containing tin as the main component refers to an alloy plating layer in which the weight of tin is greater than the weight of the other alloy components. The coating layer composed of molybdenum disulfide as the main component refers to an alloy coating layer in which the weight of molybdenum disulfide is the greatest among the contained components, except for a binder.

With this arrangement, the coating layer, which serves as a solid lubricant layer, is formed on the surface of the swash plate on the shoes which make sliding contact, so that good lubricating performance can be achieved. The coating layer has the shortcoming of poor wear resistance; hence, it is possible that the coating layer may wear or peel after an extended period of use because of the high sliding contact load applied when the pistons reach their top dead centers. However, the plating layer is applied under the coating layer; the plating layer exhibits high wear resistance, and the plating layer and the molybdenum disulfide in the coating layer have good affinity. Further, the sliding contact surfaces of the swash plate and the shoes are periodically subjected to high and low sliding contact load. Hence, when the sliding contact load decreases intermittently, frictional heat causes the coating layer to flow to the portion which has worn or peeled. Thus, the portion of the plating layer which has been exposed due to wearing or peeling, is re-covered and repaired by the coating layer as a solid lubricant layer.

As set forth above, whenever the sliding contact load decreases, the coating layer is repaired, permitting high lubricating performance to be maintained for a long period of time.

Thus, providing the coating layer mainly composed of molybdenum disulfide on the plating layer composed of tin or the alloy, which contains tin as the main component, improves its adhesion to the base metal. The coating layer also has a self-repairing function. This enables long lasting high lubricating performance.

In a preferred form of the invention, the swash plate is made of aluminum or an aluminum alloy, and the sliding contact surface of the swash plate is provided with the plating layer as a surface treating layer.

With this arrangement, the adhesion between the plating layer and the base metal is improved and the service life of the plating layer is extended, thus enabling high lubricating performance to be maintained for a longer period of time.

In another preferred form of the invention, the aforesaid surface of the swash plate is arranged so that primary crystal silicon particles are exposed. The plating layer composed of tin or an alloy containing tin as the main component is provided as the surface treating layer on the exposed surface of the swash plate.

With this arrangement, adhesion between the plating layer and the base metal is further improved, allowing high lubricating performance to be maintained for an even longer period of time.

In another preferred form of the invention, the coating layer on a plating layer contains graphite as an additional component.

With this arrangement, the coating layer provides better lubrication between the surface of the swash plate and the shoes than a coating layer which, excepting for a binder, is composed only of molybdenum disulfide.

BRIEF DESCRIPTION OF THE DRAWINGS

The above and other objects, features and advantages of the present invention will become apaparent from the ensuing description of preferred embodiments of the present invention in conjunction with the accompanying drawings wherein.

DESCRIPTION OF THE PREFERRED EMBODIMENTS

A swash plate type compressor having double-headed pistons which is an embodiment of the present invention will now be described in conjunction with FIG. 1 to FIG. 3.

Figure 1:
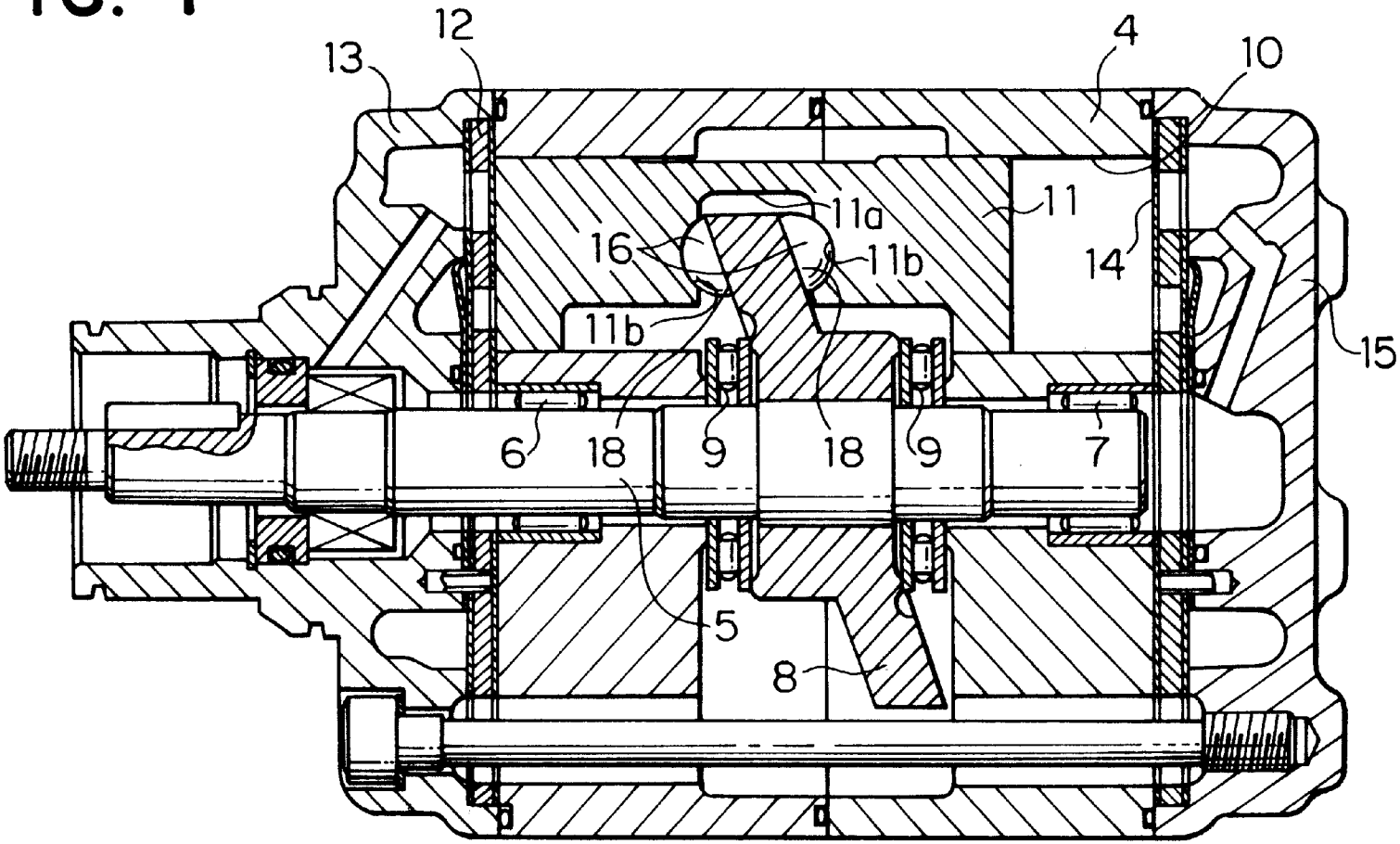
FIG. 1 is a sectional view illustrating the entire structure of a swash plate type compressor having double-headed pistons according to an embodiment of the present invention.
Figure 2:
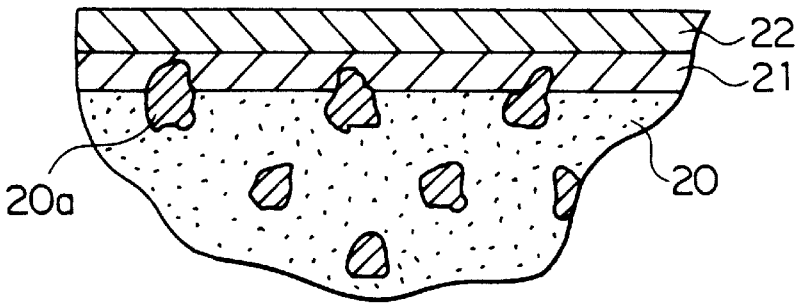
FIG. 2 is a schematic sectional view showing an essential section of the present invention, namely, the surface of the swash plate main body, wherein the swash plate is provided with a plating layer and also a coating layer, the coating layer being formed on the plating layer.

FIG. 1 is a general sectional view showing the swash plate type compressor having double-headed pistons according to the embodiment. In the drawing, a drive shaft 5 is rotatably journaled via bearings 6, 7 in a cylinder block assembly 4. A swash plate 8 is connected and secured to the drive shaft 5, and thrust bearings 9 are disposed at the front and rear of the swash plate 8. The cylinder block assembly 4 is provided with five cylinder bores 10 normally formed at equal intervals of 72 degrees; double-headed pistons 11 are axially slidably fitted in the respective cylinder bores 10. The front end opening of the cylinder block assembly 4 is closed by a valve plate 12 and a front housing 13, and the rear end opening thereof is closed by a valve plate 14 and a rear housing 15.

A recessed section 11*a* for receiving the outer periphery of the swash plate 8 is formed at the center of each double-headed piston 11; sockets 11*b* are formed on the axially opposed surfaces of each recessed section 11*a*. Hemispherical shoes 16 are in sliding contact with the sliding contact surface of the swash plate 8 so that the double-headed pistons 11 are reciprocated as the swash plate 8 rotates. This construction is basically the same as that of a typical conventional swash plate type compressor having double-headed pistons.

In this embodiment, the shoes employ a ferrous metal such as stainless steel as a base metal. The swash plate 8 employs aluminum or an aluminum alloy as a base metal; for example, an Al—Si—Cu—Mg type alloy or an aluminum alloy which does not contain Si may be used as a base metal. It is preferable, however, to use an Al—Zr alloy which contains primary crystal silicon in the form of hard coarse particles; Al—Zr alloy features a high content of silicon, namely, about 13 to about 30 percent by weight, which is higher than that of a eutectic composition, and has primary crystal silicon in its matrix.

In this embodiment, a sliding contact surface 18 of the swash plate 8 which is in sliding contact with the shoes 16 is configured as described below. As shown in the sectional view in FIG. 2, the swash plate 8 is formed so that a plating layer 21 composed of tin or an alloy containing tin as the main component is formed as a surface treating layer on the surface of a swash plate main body 20 which employs, as the base metal thereof, an Al—Zr alloy containing 17 percent by weight of silicon, and a coating layer 22 mainly composed of molybdenum disulfide is formed as a solid lubricant layer on the plating layer 21. Preferably, the coating layer 22 contains graphite as an additional component to improve lubricating performance.

To form the foregoing plating layer, the surface of the swash plate 8 is polished for finish, and primary crystal silicon particles 20*a* scattered in the base metal of the swash plate main body 20 are arranged so that they project from the surface and are exposed, then a publicly known tinning process is performed. This further improves the adhesion between the plating layer 21 and the swash plate main body 20.

The plating layer 21 is comprised of tin and a metal selected from among zinc, lead, and indium; hence, the plating layer 21 enables the frictional coefficient to be kept low and permits higher hardness than a plating layer composed only of tin, thus leading to high wear resistance.

In the composition described above, the sliding contact surfaces of the swash plate 8 and the shoes 16 are subjected to maximum sliding contact load when the pistons 11 are at their top dead centers, while they are subjected to minimum sliding contact load when the pistons 11 are at their bottom dead centers.

Accordingly, with extended use of the swash plate type compressor, the wear resistance of the coating layer 22 deteriorates and the coating layer 22 wears or peels when the pistons 11 are at the top dead centers, and this causes the plating layer 21 to be exposed on the surface.

The adhesion of the plating layer, 21 with the base metal, however, is stronger than that of the coating layer and the plating layer 21 has higher hardness and higher wear resistance; therefore, the plating layer 21 does not wear or peel. In addition, the coating layer 22 exhibits good affinity for the plating layer 21. Further, the shoes 16 are disposed at equal intervals, e.g. at 72-degree intervals in this embodiment, along the circumference around the axis of the drive shaft 5; hence, the sliding contact load does not act on the sliding contact surface when moving between the shoes 16. For this reason, while the sliding contact load is not being applied to a shoe 16, the coating layer composed primarily of molybdenum disulfide is melted by residual frictional heat and flows to a worn or peeled portion of the coating layer 22 to recover the exposed plating layer 21 thereby repairing the coating layer 22.

Thus, according to the embodiment, high lubricating performance of the sliding contact surfaces of the swash plate 8 and the shoes 16 is maintained for a long period of time.

Figure 3:
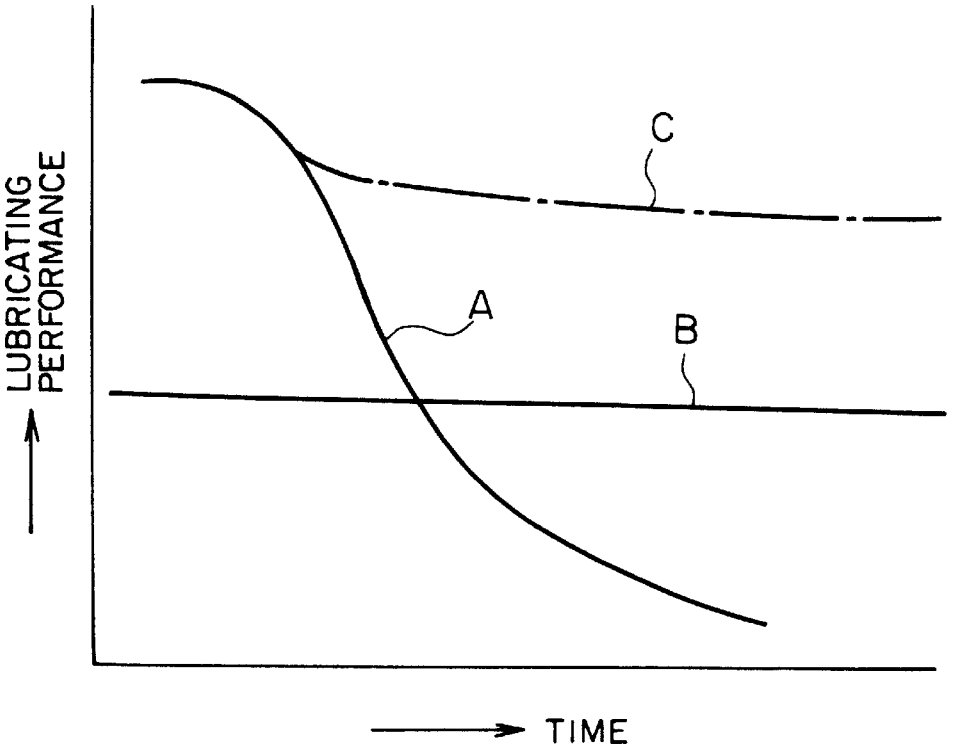
FIG. 3 is a schematic chart showing a comparison in lubricating performance between a swash plate provided with the plating layer and the coating layer of the present invention shown in FIG. 2 and plates provided with conventional surface layers.

FIG. 3 shows the comparison in lubricating performance between a coating A in which an alloy coating layer employing molybdenum disulfide as the chief component is formed directly on the surface of a base metal, e.g. a proposal disclosed in Japanese Patent Application Laid-open No. 60-22080, a coating B in which an alloy plating layer employing tin as the chief component is formed directly on the surface of a base metal, e.g. a proposal disclosed in Japanese Patent Application Laid-open No. 2-130272, and a coating C which is according to the present invention.

In the case of a coating A, high lubricating performance is observed at the beginning, but afterward the performance suddenly deteriorates due to the occurrence of wearing or peeling because of poor wear resistance. In the case of coating B, no marked change is observed in lubricating performance after an extended period of time since coating B has good adhesion to the base metal and provides high wear resistance; however, coating B per se does not have very good lubricating performance. In contrast to the conventional publicly known coatings A and B, coating C, according to the embodiment indicated by the chain line in FIG. 3, provides high lubricating performance imparted by the coating layer 22 since the coating layer 22 develops no wearing or peeling in the early stage of use. When coating C starts to wear or peel during an extended period of use, it shows slight deterioration in lubricating performance; however, the repairing action of the coating layer 22 described above makes it possible to maintain high lubricating performance for a long time afterward.

The foregoing plating layer 21 and the coating layer 22 may be formed on the sliding contact surfaces of the shoes 16 rather than on the surface of the swash plate main body 20. In this case, the sliding contact surfaces of the shoes 16 are constantly subjected to a sliding contact load; however, since the pistons 11 make one round trip between the top dead center and the bottom dead center when the swash plate 8 makes one turn, the sliding contact load constantly changes, allowing the repairing function of the coating layer 22 to be implemented when the sliding contact load is low.

In general, the swash plate 8 is formed using aluminum or an aluminum alloy, and the shoes 16 are fabricated using stainless steel or an other ferrous metal. Accordingly, forming the plating layer 21 and the coating layer 22 on the surface of the swash plate 8 provides good adhesion between the plating layer 21 and the base metal which is superior to that between the plating layer and the shoes 16 made of steel or other ferrous metal. This provides high wear resistance and makes it possible to maintain high lubricating performance for longer period of time.

In the aforementioned embodiment, the plating layer 21 and the coating layer 22 have been formed on the entire surface of the swash plate main body 20; however, the plating layer 21 and the coating layer 22 may be formed on the entire surfaces of the shoes 16 as described above, or they may be formed partially on the sliding contact surface of the swash plate 8 or the shoes 16.

Although the present invention has been described in connection with the preferred embodiments, the invention is not limited thereto. For example, this invention is not restricted to a swash plate type compressor having double-headed pistons. This invention is also applicable to a swash plate type of variable displacement compressor having single-headed pistons. It will be easily understood by those of ordinary skill in the art that variations and modifications can be easily made within the scope and spirit of this invention as defined by the appended claims.

What is claimed is:

1. A swash plate type compressor comprising:

a drive shaft;

a cylinder block assembly having a plurality of cylinder bores parallel to said drive shaft;

said drive shaft being rototably supported in said cylinder block assembly;

a swash plate connected to said drive shaft in said cylinder block assembly for rotation with said drive shaft;

pistons slidably disposed in said cylinder bores; and shoes slidably provided between said pistons and said swash plate, said shoes for reciprocating said pistons in response to the rotation of said swash plate;

wherein said swash plate and said shoes come in sliding contact during rotation of said swash plate and a sliding contact surface of either said swash plate or said shoes is covered with a plating layer composed of tin or an alloy containing tin as the main component, as a surface treating layer, and said plating layer is covered by a coating layer containing molybdenum disulfide as the main component which serves as a solid lubricant layer.

2. A swash plate type compressor according to claim 1, wherein said swash plate is made of aluminum or an aluminum alloy, and said sliding contact surface of said swash plate is provided with said plating layer, as said surface treating layer.

3. A swash plate type compressor according to claim 2, wherein primary crystal silicon particles protrude from the surface of the swash plate, and said plating layer is provided as said surface treating layer on said surface of said swash plate, covering the protruding silicon particles.

4. A swash plate compressor according to claim 1, wherein the coating layer contains graphite as an additional component.

5. A swash plate for being coupled to a piston through shoes in a compressor, comprising:

surfaces for sliding contact with the shoes;

plating layers of tin or an alloy containing tin as the main component, coating each of the respective surfaces; and coating layers containing molybdenum disulfide as the main component coating each respective plating layer, wherein each of the coating layers repairs worn or peeled portions of the respective coating layer during operation.

6. A swash plate according to claim 5, wherein primary crystal silicon particles protrude from the surface of the swash plate and said plating layer is provided as said surface treating layer on said surface of said swash plate, covering the protruding silicon particles.

7. A swash plate according to claim 6, wherein the coating layer contains graphite.

8. A shoe for coupling a swash plate to a piston in a compressor, comprising:

a surface for sliding contact with the swash plate;

a plating layer of tin or an alloy containing tin as the main component, coating the surface; and a coating layer containing molybdenum disulfide as the main component coating the plating layer.

9. A shoe according to claim 8, wherein the coating layer contains graphite.

10. A swash plate type compressor comprising:

a drive shaft;

a cylinder block assembly having a plurality of cylinder bores parallel to said drive shaft;

said drive shaft being rototably supported in said cylinder block assembly;

a swash plate coupled to said drive shaft in said cylinder block assembly for rotation with said drive shaft;

pistons slidably disposed in said cylinder bores;

shoes slidably located between said pistons and said swash plate, said shoes engaging a portion of the swash plate surface to reciprocate said pistons in response to the rotation of said swash plate; and the portion of swash plate surface engaging the shoes being covered with a first layer comprising tin and a second layer comprising molybdenum disulfide covering the first layer, wherein portions of the second layer flow during operation to fill worn or peeled portions of the second layer.

* * * * *